US009048576B2

(12) United States Patent
McGivern et al.

(10) Patent No.: US 9,048,576 B2
(45) Date of Patent: Jun. 2, 2015

(54) MULTIPLE-STAGE INTERLOCKING ELECTRICAL CONNECTOR WITH LOCKING ASSURANCE MECHANISM

(71) Applicant: GM Global Technology Operations LLC, Detroit, MI (US)

(72) Inventors: Joseph F. McGivern, Shelby Township, MI (US); Gary W. Taraski, Oxford, MI (US); Paul B. Stambaugh, Dearborn, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 42 days.

(21) Appl. No.: 13/958,092

(22) Filed: Aug. 2, 2013

(65) Prior Publication Data

US 2015/0037997 A1 Feb. 5, 2015

(51) Int. Cl.
*H01R 13/627* (2006.01)

(52) U.S. Cl.
CPC ..... *H01R 13/6273* (2013.01)

(58) Field of Classification Search
CPC ..... H01R 13/6275; H01R 13/6272; H01R 13/6273
USPC ..... 439/357, 358
See application file for complete search history.

(56) References Cited

U.S. PATENT DOCUMENTS

| | | | | | |
|---|---|---|---|---|---|
| 5,330,366 | A * | 7/1994 | Tsuji et al. | 439/352 |
| 5,334,041 | A * | 8/1994 | Anbo et al. | 439/358 |
| 5,702,266 | A * | 12/1997 | Jones | 439/357 |
| 5,741,150 | A * | 4/1998 | Stinson et al. | 439/358 |
| 6,123,575 | A * | 9/2000 | Huang et al. | 439/489 |
| 6,364,699 | B1 * | 4/2002 | Hwang et al. | 439/555 |
| 6,428,341 | B2 * | 8/2002 | Kinezuka et al. | 439/358 |
| 6,450,830 | B1 * | 9/2002 | Koseki | 439/352 |
| 6,488,518 | B2 * | 12/2002 | Mlyniec | 439/180 |
| 6,648,669 | B1 * | 11/2003 | Kim et al. | 439/357 |
| 6,676,433 | B1 * | 1/2004 | Ozaki | 439/353 |
| 6,821,024 | B2 * | 11/2004 | Bates, III | 385/76 |
| 6,860,748 | B2 * | 3/2005 | Ohtani et al. | 439/352 |
| 7,448,896 | B2 * | 11/2008 | Malak et al. | 439/352 |
| 7,503,795 | B2 * | 3/2009 | Yamaji et al. | 439/358 |
| 7,824,208 | B2 * | 11/2010 | Crofoot et al. | 439/352 |
| 7,892,012 | B1 * | 2/2011 | Foung | 439/352 |
| 2001/0021603 | A1 * | 9/2001 | Chen | 439/358 |
| 2006/0134964 | A1 * | 6/2006 | Ohtaka et al. | 439/358 |
| 2006/0205262 | A1 * | 9/2006 | Buchter et al. | 439/358 |

* cited by examiner

*Primary Examiner* — Gary Paumen
(74) *Attorney, Agent, or Firm* — Cantor Colburn LLP

(57) ABSTRACT

An electrical connector assembly comprises a primary connector housing, a mating connector housing, a primary lock, and a secondary lock. The primary lock is defined by both the primary connector housing and the mating connector housing. The secondary lock is supported by the mating connector housing and is arranged and configured for interacting with the primary lock so as to prevent the primary lock, when positioned in a locked position, from disengaging. The primary lock comprises a lock arm extending from the primary connector housing and a lock lever extending from the mating connector housing.

18 Claims, 1 Drawing Sheet

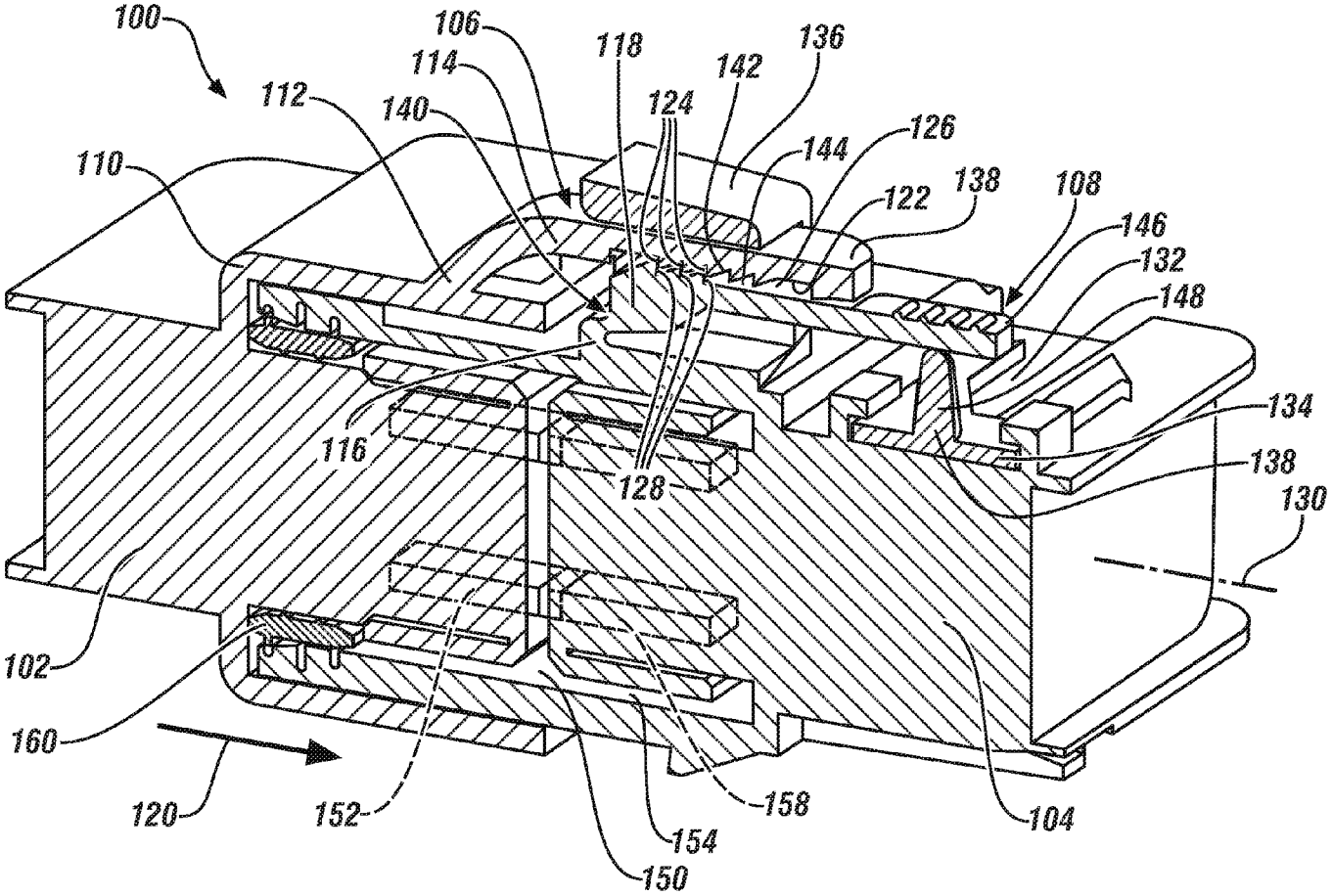
100
106
114
140
112
110
118
124
142
136
144
126
122
138
108
146
132
148
134
138
130
104
158
154
150
128
116
152
120
160
102

MULTIPLE-STAGE INTERLOCKING ELECTRICAL CONNECTOR WITH LOCKING ASSURANCE MECHANISM

FIELD OF THE INVENTION

The subject invention relates to electrical connectors and more particularly to a multiple-stage interlocking electrical connector assembly having a locking assurance mechanism with both primary and secondary locking features.

BACKGROUND

In today's world, vehicles are often equipped with a large quantity of electrical connectors facilitating assembly of modular components along an assembly line. Once a vehicle is assembled and enters service, it is desirable for the electrical connector assemblies to remain in an assembled state until they are intentionally disassembled. Unfortunately, vibration and other factors may result in premature disassembly of an electrical connector assembly. To mitigate the risk of premature undesired disassembly or disengagement of an electrical connector assembly, locking features may be incorporated into the electrical connector assembly.

Accordingly, it is desirable to have an improved electrical connector assembly providing multiple-stages of interlocking engagement between the electrical connectors that form the assembly. It would also be advantageous to have an electrical connector assembly with a and improved locking assurance mechanism that includes both primary and secondary locking features.

SUMMARY OF THE INVENTION

In an exemplary embodiment of the invention, an electrical connector assembly comprises a primary connector housing, a mating connector housing, a primary lock, and a secondary lock. The primary lock is defined by both the primary connector housing and the mating connector housing. The secondary lock is supported by the mating connector housing and is arranged and configured for interacting with the primary lock so as to prevent the primary lock, when positioned in a locked position, from disengaging. The primary lock comprises a lock arm extending from the primary connector housing and a lock lever extending from the mating connector housing.

In another aspect, an exemplary retention lock mechanism for an electrical connector assembly comprises a primary lock and a secondary lock. The primary lock is defined in part by the primary connector housing and in part by the mating connector housing. The secondary lock is supported by the mating connector housing and is arranged and configured for interacting with the primary lock so as to prevent the primary lock, when positioned in a locked position, from disengaging. The primary lock comprises a lock arm extending from the primary connector housing and a lock lever extending from the mating connector housing.

In a further aspect, an electrical connector assembly comprises a primary connector housing, a mating connector housing, a primary lock defined by the primary connector housing and the mating connector housing, and a secondary lock supported by the mating connector housing. The secondary lock is arranged and configured for interacting with the primary lock so as to prevent the primary lock, when positioned in a locked position, from disengaging. The primary lock comprises a lock arm extending from the primary connector housing and a lock lever extending from the mating connector housing. The lock arm has an engagement surface that defines a plurality of lock steps along the engagement surface, and the lock lever has a lock lever surface that defines a plurality of mating lock lever steps along the lock lever surface.

The above features and advantages and other features and advantages of the invention are readily apparent from the following detailed description of the invention when taken in connection with the accompanying drawings.

BRIEF DESCRIPTION OF THE DRAWING

Other features, advantages and details appear, by way of example only, in the following detailed description of embodiments, the detailed description referring to the drawing, in which the FIGURE is a cutaway image showing an electrical connector assembly in accordance with an exemplary embodiment of the invention.

DESCRIPTION OF THE EMBODIMENTS

The following description is merely exemplary in nature and is not intended to limit the present disclosure, its application or uses.

In accordance with various exemplary embodiments, the FIGURE shows an exemplary multiple-stage interlocking electrical connector assembly 100 having both primary and secondary locking features. As shown in the FIGURE, the electrical connector assembly 100 comprises a primary connector housing 102, a mating connector housing 104, a primary lock 106 and a secondary lock 108. The primary lock 106 is defined by portions of both the primary connector housing 102 and the mating connector housing 104 and is configured such that, when the primary lock 106 is engaged, disengagement of the mating connector housing 104 from the primary connector housing 102 (i.e., movement of the mating connector housing 104 away from the primary connector housing 102) is prevented. The secondary lock 108 is supported by the mating connector housing 104 and is arranged and configured for interacting with a portion of the primary lock 106 so as to prevent the primary lock 106 from permitting disengagement of the mating connector housing 104 from the primary connector housing 102.

In an exemplary embodiment, the primary connector housing 102 includes an outer wall 110 that provides a lock arm base 112, from which a lock arm 114 is cantilevered. The lock arm 114 extends from the lock arm base 112 along an engagement direction 120. The mating connector housing 104 similarly provides a lock lever base 116, from which a lock lever 118 is cantilevered. The lock lever 118 extends from the lock lever base 116 along the engagement direction 120, parallel to the lock arm 114. In accordance with this embodiment, the primary lock 106 comprises the lock arm 114 and the lock lever 118 extending parallel to one another.

As shown in the FIGURE, the lock arm 114 provides an engagement surface 122 that faces toward the lock lever 118 and that extends, with the lock arm 114, along the engagement direction 120. The engagement surface 122 includes a plurality of lock steps 142 disposed at regular intervals along the engagement surface 122. Similarly, the lock lever 118 provides a lock lever surface 126 that faces toward the lock arm 114 and that extends, with the lock lever 118, along the engagement direction 120 from the lock lever base 116. The lock lever surface 126 includes a plurality of mating lock lever steps 144 disposed along the lock lever surface 126 at intervals corresponding to the intervals at which the plurality of lock steps 142 are disposed. In an exemplary embodiment, the engagement surface 122 is arranged so as to face inwardly toward a centerline 130 of the mating connector housing 104, and the lock lever surface 126 is arranged so as to face outwardly toward the engagement surface 122 (i.e., away from the centerline 130 of the mating connector housing 104).

In an exemplary embodiment, the secondary lock 108 is disposed in a guide channel 132 defined by the mating connector housing 104. The guide channel 132 may be arranged transversely to the engagement direction 120 so as to prevent movement of the secondary lock 108 as the primary connector housing 102 moves relatively to the mating connector housing 104 along the engagement direction 120. The secondary lock 108 includes a base 134 that is configured for cooperating with the guide channel 132 so as to constrain movement of the secondary lock 108 along the guide channel 132 when the base 134 is disposed in the guide channel 132.

In an exemplary embodiment, a lock retention band 136 is disposed about the lock arm 114 and configured so as to prevent the lock arm 114 from deforming excessively outwardly from the centerline 130 of the mating connector housing 104. The lock arm 114 includes a guide surface 138 that faces outwardly from the lock arm 114, away from the centerline 130 of the mating connector housing 104 and toward the lock retention band 136. The lock retention band 136 is supported by the mating connector housing 104 or by the primary connector housing 102 and is disposed over the lock arm 114, adjacent to the guide surface 138. The lock retention band 136 is configured such that excessive outward deflection of the lock arm 114 results in contact between the guide surface 138 and the lock retention band 136. Accordingly, the lock retention band 136 is configured to prevent the lock arm 114 from deforming outwardly and thereby disengaging its engagement surface 122 (and the plurality of lock steps 142) from the lock lever surface 126 (and the plurality of mating lock lever steps 144) of the lock lever 118.

Each of the plurality of lock steps 142 defines a lock surface 124 disposed so as to face substantially toward a direction that opposes the engagement direction 120 (i.e., so as to face substantially in opposition to the engagement direction 120) and so as to be angled partially toward the guide surface 138. Each of the plurality of mating lock lever steps 144 defines a mating lock step surface 128 that is disposed so as to face substantially toward the engagement direction 120 and so as to be angled partially toward the centerline 130. Each of the plurality of lock steps 142 comprises the lock surface 124 disposed so as to face substantially toward a direction that opposes the engagement direction 120 (i.e., so as to face substantially in opposition to the engagement direction 120). Each of the plurality of mating lock lever steps 144 defines the mating lock step surface 128.

The electrical connector assembly 100 further comprises a control arm 146 that extends from the lock lever 118. The lock lever 118 is configured to deform at or near a flex point 140 such that a position of the lock surface 124 may be manipulated transversely to the engagement direction 120 as the control arm 146 is moved inwardly toward the centerline 130 or outwardly away from the centerline 130.

As described above, the secondary lock 108 is disposed in the guide channel 132 that is defined by the mating connector housing 104, and the guide channel 132 is arranged transversely to the engagement direction 120. Accordingly, the secondary lock 108 is arranged such that friction between the control arm 146 and the secondary lock 108, such as may be produced when the control arm 146 moves along the engagement direction 120, may have little or no impact on the position of the secondary lock 108 along the guide channel 132. The secondary lock 108 includes a biasing member 148 that is supported by the base 134, that extends outwardly from the base 134, and that cooperates with the control arm 146 to support the control arm 146 relatively to the centerline 130 and to thereby prevent the control arm 146 from inadvertently moving, and from being intentionally or accidentally manipulated so as to move, toward the centerline 130.

It should be appreciated, therefore, that when the secondary lock 108 is disposed in the guide channel 132, the base 134 of the secondary lock 108 cooperates with the guide channel 132 so as to reliably position the secondary lock 108 (i.e., the biasing member 148) between the mating connector housing 104 and the control arm 146. The secondary lock 108 (i.e., the biasing member 148) is sized and shaped such that the secondary lock 108 is disposed in a state of compression between the mating connector housing 104 and the control arm 146. Because the guide channel 132 is arranged so as to constrain movement of the base 134 transversely to the engagement direction 120, and because movement of the mating connector housing 104 relative to the primary connector housing 102 is constrained to be along the engagement direction 120, such relative movement between the primary connector housing 102 and the mating connector housing 104, even if not inhibited, would be ineffective, and therefore unlikely, to cause the secondary lock 108 to move within the guide channel 132. Accordingly, the secondary lock 108 is configured to be positioned and reliably retained within the guide channel unless and until the secondary lock is intentionally translated along the guide channel, such as when it might be intentionally and forceably removed so as to facilitate intentional disengagement of the mating connector housing 104 from the primary connector housing 102.

It should be appreciated that the secondary lock 108 may be pre-assembled in the guide channel 132 prior to mating of the primary connector housing 102 with the mating connector housing 104. Thus, the assembly-line process of mating the primary connector housing 102 with the mating connector housing 104 may be simplified such that locking assurance associated with the secondary lock 108 may be provided without the complexity or burden that might otherwise be associated with final mating assembly.

In use, as the primary connector housing 102 is mated with the mating connector housing 104 along the engagement direction 120, the lock surface 124 first engages the mating lock step surface 128 (i.e., each one of the plurality of lock steps 142 engages a corresponding one of the plurality of mating lock lever steps 144) such that disengagement of the primary connector housing 102 from the mating connector housing 104 is prevented. Thus, as soon as one of the plurality of lock steps 142 engages a corresponding one of the plurality of mating lock lever steps 144 disengagement of the primary connector housing 102 from the mating connector housing 104 is prevented even though it may be possible for the mating connector housing 104 to be inserted more deeply into the primary connector housing 102.

As the primary connector housing 102 is moved toward further engagement with the mating connector housing 104, additional ones of the lock surfaces 124 come into engagement with additional ones of the mating lock step surfaces 128 (i.e., additional ones of the plurality of lock steps 142 engage additional ones of the mating lock lever steps 144). Accordingly, the electrical connector assembly 100 provides a multi-stage, ratcheting mechanism that facilitates a range of engaged positions along the engagement direction 120 while preventing incremental disengagement of the primary connector housing 102 from the mating connector housing 104.

In an exemplary embodiment, the outer wall 110 of the primary connector housing 102 defines a connector cavity 150, in which one or more connector terminals 152 are disposed. The outer wall 110 also defines an opening 154 for receiving the mating connector housing 104 for insertion into the connector cavity 150. The mating connector housing 104 is configured (i.e., sized and shaped and having external dimensions) so that the mating connector housing 104 may be inserted through the opening 154 and into the connector cavity 150. One or more mating connector terminals 158 extend from the mating connector housing 104. An elastomeric seal 160 may be disposed within the connector cavity 150 and arranged for engaging both the mating connector housing 104 and the outer wall 110 of the primary connector housing 102 and to thereby provide a resilient seal therebetween. Accordingly, the elastomeric seal 160 may be configured to cooperate with the primary connector housing 102 and the mating connector housing 104 so as to prevent infiltration of contaminants (e.g., dirt, dust, moisture) into the connector cavity 150 when the the mating connector housing 104 is seated within the primary connector housing 102.

It should be appreciated that connector terminals 152 and the mating connector terminals 158 may be configured, in coordination with the arrangement of the lock surfaces 124 and the mating lock step surfaces 128, such that electrical contact between the connector terminals 152 and the mating connector terminals 158 is assured to have been initiated as soon as mechanical locking contact is provided by the interaction of the lock surfaces 124 and the mating lock step surfaces 128. It should also be appreciated that connector terminals 152 and the mating connector terminals 158 may be configured, in coordination with the arrangement of the lock surfaces 124 and the mating lock step surfaces 128, such that further electrical contact between the connector terminals 152 and the mating connector terminals 158 is assured to be maintained as long as mechanical locking contact is provided by the interaction of the lock surfaces 124 and the mating lock step surfaces 128. Thus, a range of assembled and locked positions may be associated with successful electrical coupling between the connector terminals 152 and the mating connector terminals 158, and tactile feedback provided by the engagement and reverse-direction prevention of the lock surfaces 124 and the mating lock step surfaces 128 may enable a user to be assured that proper electrical connection is achieved. As a result, the audible click requirements associated with conventional connection systems may be eliminated in view of the tactile feedback provided by the instant invention.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the application.

What is claimed is:

1. An electrical connector assembly comprising:

a primary connector housing;

a mating connector housing;

a primary lock defined by the primary connector housing and the mating connector housing;

and a secondary lock supported by the mating connector housing, the secondary lock arranged and configured for interacting with the primary lock so as to prevent the primary lock, when positioned in a locked position, from disengaging;

the primary lock comprising a lock arm extending from the primary connector housing and a lock lever extending from the mating connector housing; and a lock retention band disposed about the lock arm and configured so as to prevent the lock arm from deforming excessively outwardly from a centerline of the mating connector housing.

2. The electrical connector assembly of claim 1, wherein the primary connector housing includes an outer wall providing a lock arm base, from which the lock arm is cantilevered and wherein the outer wall defines a connector cavity, in which one or more connector terminals are disposed.

3. The electrical connector assembly of claim 2, wherein the mating connector housing provides a lock lever base, from which the lock lever is cantilevered.

4. The electrical connector assembly of claim 3:

wherein the lock arm extends along an engagement direction from the lock arm base; and wherein the lock lever extends along the engagement direction from the lock lever base.

5. The electrical connector assembly of claim 1, wherein the secondary lock is disposed in a guide channel defined by the mating connector housing and wherein the secondary lock includes a base that is configured for cooperating with the guide channel so as to be retained within the guide channel unless and until the secondary lock is translated along the guide channel.

6. The electrical connector assembly of claim 1, wherein the lock retention band is supported by the mating connector housing.

7. The electrical connector assembly of claim 1, wherein the lock arm has a guide surface facing outwardly from a centerline of the mating connector housing.

8. The electrical connector assembly of claim 2, wherein the outer wall defines a connector cavity, in which one or more connector terminals are disposed.

9. The electrical connector assembly of claim 8, wherein the outer wall defines an opening for receiving a mating connector housing for insertion into the connector cavity.

10. The electrical connector assembly of claim 9:

wherein the mating connector housing is configured to be inserted through the opening and into the connector cavity.

11. The electrical connector assembly of claim 8, wherein an elastomeric seal is disposed within the connector cavity and arranged for engaging both the outer wall of the primary connector housing and the outer wall of the mating connector housing.

12. An electrical connector assembly comprising:

a primary connector housing;

a mating connector housing;

a primary lock defined by the primary connector housing and the mating connector housing;

and a secondary lock supported by the mating connector housing, the secondary lock arranged and configured for interacting with the primary lock so as to prevent the primary lock, when positioned in a locked position, from disengaging;

the primary lock comprising a lock arm extending from the primary connector housing and a lock lever extending from the mating connector housing;

wherein the lock arm has an engagement surface that defines a plurality of lock steps along the engagement surface; and wherein the lock lever has a lock lever surface that defines a plurality of mating lock lever steps along the lock lever surface.

13. The electrical connector assembly of claim 12:

wherein the engagement surface is arranged so as to face inwardly toward a centerline of the mating connector housing; and wherein the lock lever surface is arranged so as to face outwardly from a centerline of the mating connector housing.

14. The electrical connector assembly of claim 12:

wherein the lock arm has a guide surface facing outwardly from a centerline of the mating connector housing;

wherein each of the plurality of lock steps defines a lock surface disposed so as to face substantially in opposition to an engagement direction and partially toward the guide surface; and wherein each of the plurality of mating lock lever steps defines a mating lock step surface disposed so as to face substantially toward the engagement direction and partially toward the centerline.

15. The electrical connector assembly of claim 12:

wherein each of the plurality of lock steps comprises a lock surface disposed so as to face substantially in opposition to an engagement direction; and wherein each of the plurality of mating lock lever steps defines a mating lock step surface.

16. The electrical connector assembly of claim 14, further comprising a control arm that extends from the lock lever, wherein the lock lever is configured to deform at or near a flex point such that the lock surface may be manipulated transversely to an engagement direction as the control arm is moved inwardly toward the centerline or outwardly from the centerline.

17. The electrical connector assembly of claim 16:

wherein the secondary lock is disposed in a guide channel defined by the mating connector housing; and wherein the guide channel is arranged transversely to the engagement direction such that the secondary lock is not induced to move along the guide channel even if the control arm is moved along the engagement direction.

18. The electrical connector assembly of claim 16, wherein the secondary lock includes a biasing member supported by a base and extending outwardly from the base and cooperating with the control arm to support the control arm relative to the centerline and prevent the control arm from being manipulated toward the centerline.

* * * * *